US006363675B1

(12) United States Patent
Shelton

(10) Patent No.: US 6,363,675 B1
(45) Date of Patent: Apr. 2, 2002

(54) ANCHORED RESILIENT ATHLETIC FLOORING STRUCTURE

(76) Inventor: Floyd Shelton, 901 E. Thomas St., Wausau, WI (US) 54403

( * ) Notice: Subject to any disclaimer, the term of this patent is extended or adjusted under 35 U.S.C. 154(b) by 0 days.

(21) Appl. No.: 09/637,161

(22) Filed: Aug. 14, 2000

(51) Int. Cl.[7] ..... E04F 15/22
(52) U.S. Cl. ..... 52/403.1; 52/480; 52/302.1
(58) Field of Search ..... 52/403.1, 480, 52/302.1

(56) References Cited

U.S. PATENT DOCUMENTS

| | | | | | |
|---|---|---|---|---|---|
| 2,743,487 | A | * | 5/1956 | Kuhlman | 52/480 X |
| 3,604,173 | A | * | 9/1971 | Ingmar | 52/480 X |
| 4,856,250 | A | * | 8/1989 | Gronau | |
| 5,016,413 | A | * | 5/1991 | Counihan | 52/403.1 X |
| 5,299,401 | A | * | 4/1994 | Shelton | 52/403.1 X |
| 5,369,927 | A | * | 12/1994 | Counihan | |
| 5,412,917 | A | * | 5/1995 | Shelton | |
| 5,526,621 | A | * | 6/1996 | Shelton | |
| 5,609,000 | A | * | 3/1997 | Niese | 52/480 |
| 5,906,082 | A | * | 5/1999 | Counihan | 52/403.1 |
| 6,122,873 | A | * | 9/2000 | Randjelovic | 52/403.1 |
| 6,164,031 | A | * | 12/2000 | Counihan | 52/480 |

FOREIGN PATENT DOCUMENTS

| | | | | |
|---|---|---|---|---|
| AT | 180712 | * | 1/1955 | 52/403.1 |
| DE | 1255900 | * | 12/1967 | 52/480 |
| DE | 2103383 | * | 8/1972 | 52/480 |
| GB | 399647 | * | 10/1933 | 52/403.1 |
| WO | WO 92/14522 | * | 9/1992 | |

* cited by examiner

*Primary Examiner*—Laura A. Callo
(74) *Attorney, Agent, or Firm*—Russell L. Johnson, Patent Agent

(57) ABSTRACT

An anchored resilient ventilated athletic flooring structure having vertical restraints secured to a base in parallel relationship to each other and the restraints have outwardly directed flanges, parallel spaced apart struts positioned under the flanges and transverse to the vertical restraints, a resilient upward biasing means secured under the struts so that the struts are resiliently engaged with the outward directed flanges of two adjacent vertical restraints, parallel spaced apart nailers secured transversely to the top surface of the struts and parallel to the vertical restraints, and a wood flooring secured transversely to the nailers. The spaced apart relationships or the struts and nailers provides a ventilated subfloor. The spaced apart relationships of the vertical restraints, struts and nailers permits the "tuning" of the subfloor by modifying the size and spacing of the subfloor components to effect changes in the measurable properties of the floor.

8 Claims, 2 Drawing Sheets

7
6
5
3
4
2

5
6
7
2
4
3
1
10

7
6
3
1
2
5
10
0

ANCHORED RESILIENT ATHLETIC FLOORING STRUCTURE

BACKGROUND OF THE INVENTION

1. Field of the Invention

This invention relates to athletic flooring structures.

Athletic flooring structures have become sophisticated in their design and technology. The old gymnasium floor has given way to the multipurpose flooring for a vast array of activities. Simple stability and durability while still critical attributes have been joined by other measurable attributes such as resilience, wave propagation and/or damping, rebound, point loading and rolling load properties, surface wear and damage resistance properties and more.

The athletic flooring industry has provided a steady stream of inventions that have led to improved quality of flooring at reduced flooring costs. Among these inventions are; inventions that provide resilience of limited amplitude and propagation, and inventions that permit air flow and ventilation throughout the subfloor.

The flooring industry has developed standards for measuring the physical properties of athletic floors. The most widely used standard is the DIN tests and DIN certification. DIN tests and certification are disclosed in detail in the applicant's U.S. Pat No. 5,299,401 to Shelton, which is incorporated herein by reference.

2. Description of the Related Art

Numerous novel structures for providing resilience and for limiting the amplitude of vertical movement permitted resilient flooring systems are present in the patent art. U.S. Pat. No. 5,412,917 to Shelton and U.S. Pat. No. 4,856,250 to Gronau et al teach sleepers that are provided with a resilient means that bears against a fixed base and provides an upward bias to the sleeper and a means for limiting the upward movement of the sleeper. U.S. Pat. No. 5,369,927 to Counihan teaches resiliently biased sleepers having outward directed restraint engaging means incorporated into the structure of the sleeper and upward movement limiting restraints secured to a base and engaging said restraint engaging means.

U.S. Pat. No. 5,526,621 to Shelton teaches an open flooring substructure that permits ventilation of said subfloor for the purpose of maintaining a dry subfloor.

The prior art known to the inventor at the time of the preparation of this specification does not show or teach a ventilated resilient subfloor that can be adjusted to provide desirable athletic flooring attributes without departing from the fundamental flooring structure.

BRIEF SUMMARY OF THE INVENTION

The invention is for an anchored ventilated resilient athletic flooring structure; comprising a multiplicity of parallel vertical restraints secured to a base and said restraints have outwardly directed lateral flanges, a multiplicity of spaced apart transverse struts positioned between said vertical restraints and under said lateral flanges and having a resilient biasing means secured underneath said struts such that said resilient biasing means supports said struts above said base so as to resiliently engage said struts with said lateral flanges, a multiplicity of spaced apart nailers secured to the tops of said struts and said nailers are laid parallel to said vertical restraints and transverse to said struts, and a continuous flooring secured to said nailers and having wood strips laid transverse to said nailers.

DETAILED DESCRIPTION OF THE INVENTION

Figure 1:
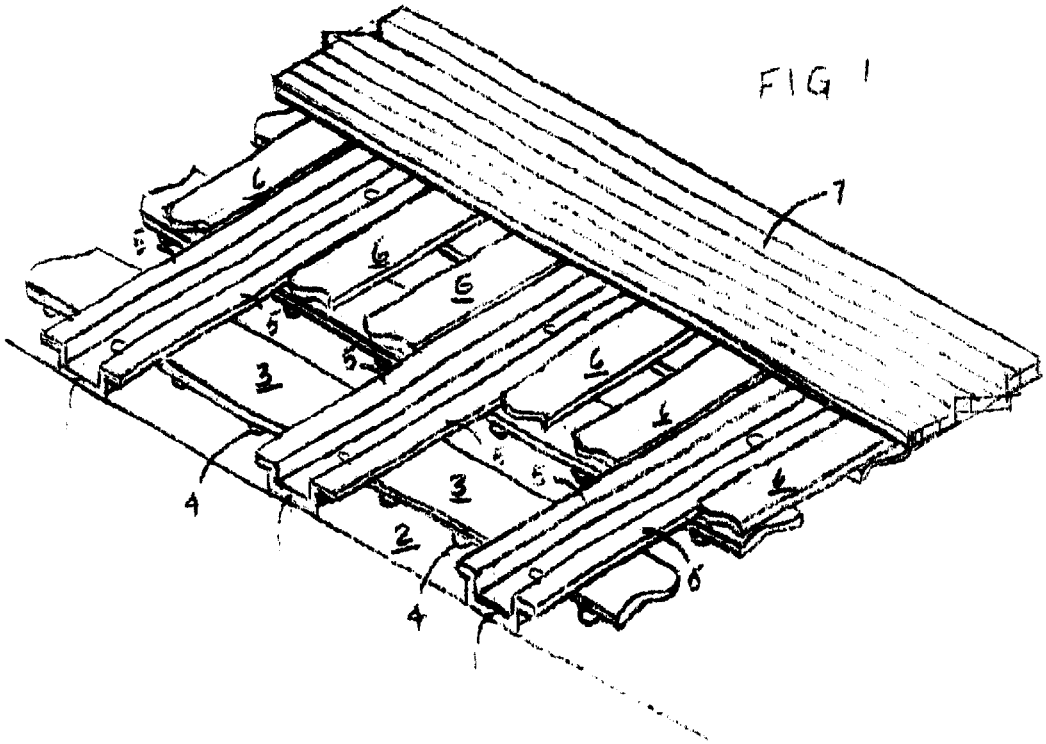
FIG. 1 is a partially sectioned perspective view of a flooring structure made according to this invention.

In the drawings, like numbers refer to like objects and the proportions of some parts have been modified to facilitate illustration.

Athletic flooring systems comprise a stable and level base, a subfloor, and a floor. The floor and the base are typically continuous level surfaces and the distance above the base to the top of the finished floor is usually called out in architectural specifications. Within the limitations imposed by the base and the floor, the subfloor serves to support the floor above the base and to give to the floor various measurable properties and serve utilitarian functions.

The principle measurable properties that are seen to be desirable of obtaining by design of the subfloor are those related to;

1) Force attenuation which is a measure the attenuation of the floors response to a weight dropped on the floor at a location,
2) Standard deformation is a measure of the vertical displacement of a test floor in response to the impact of a dropped weight,
3) Rolling load is a measure of the effects of a weighted test wheel which is rolled over a floor repeatedly, and
4 Ball rebound is a measure of the rebound of a standardized basketball dropped from a set height.

Among the desirable utilities provided by the flooring structure of this invention are those of moisture control and ventilation.

Among the novel aspects of this invention is that the contributions of the components of the sub flooring structure can be modified or"tuned", as will be disclosed below, so as to effect one or more of the measurable properties of the floor.

Figure 2:
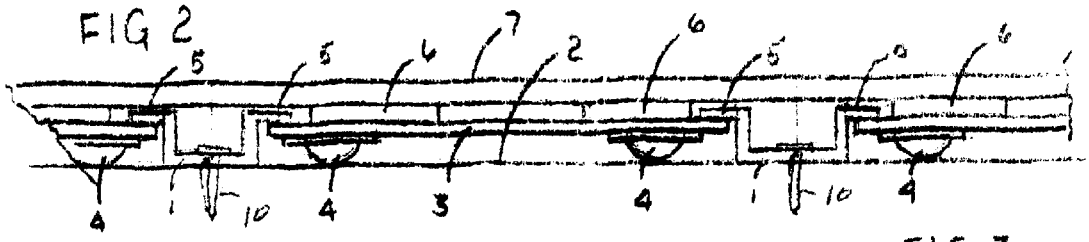
FIG. 2 is an elevational view of the flooring structure of FIG. 1 taken along line 2—2
Figure 3:
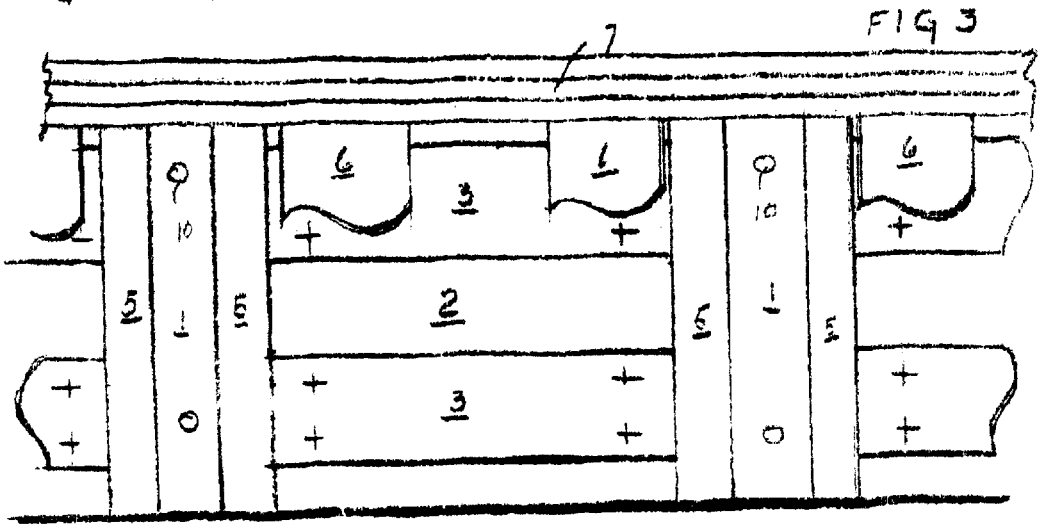
FIG. 3 is a plan view of the flooring structure of FIG. 1.

Referring now to FIGS. 1 through 3 wherein a general configuration of the components of the flooring structures are shown. Vertical restraints 1 having lateral flanges 5 are secured to base 2 with securement means 10. Vertical restraints 1 are secured in parallel spaced apart relationship to each other. Transverse struts 3 which have a resilient upward biasing means hereshown as multiple discreet resilient pads 4 secured to their bottom surface are positioned beneath lateral flanges 5 of two adjacent vertical restraints 1 in parallel spaced apart relationship to each other. Nailers 6 are secured to the top surfaces of struts 3 so as to be positioned parallel to vertical restraints 1 and spaced apart from vertical restraints 1 and each other and transverse to struts 3. Wood flooring strips 7 are secured to nailers 6 and positioned transverse thereto.

The structures disclosed above and illustrated in FIGS. 1 through 3 permit air flow from level to level in the subfloor and throughout the levels of the subfloor. In venues where moisture buildup is a problem, heretofore, specially designed ventilated flooring structures have been provided with humidistats and automatic blowers to vent and dry the air in the subfloor when the humidity in the subfloor reaches a preset level (see Shelton U.S. Pat. No. 5,526,621). However, in venues where moisture buildup is not an expected problem, events like burst pipes, sprinkler systems being activated, roof leaks, vandalism and the like can introduce a significant quantity of water into the subfloor volume of an athletic flooring system. If the subfloor is not ventilatable, damage and even destruction of the athletic floor is the expected result of significant amounts of water getting under an athletic floor. The resilient properties of the athletic flooring structures of FIGS. 1 through 3 are open structures designed to use the void spaces in the levels of the subfloor as a contributor to the measurable properties of the athletic flooring structure (see Shelton U.S. Pat. No. 5,299,401). A synergism between the subfloor void volumes and the resilience of the flooring system is one in which the resilient flexure of the floor promotes air movement throughout and between the void volumes of the subfloor and contributes to inherent ventilation of the sub flooring structures. It should be understood the spaces around the perimeter of an athletic floor that are provided for expansion and contraction are ordinarily sufficient to permit air to flow into and out of the subfloor volume.

The measurable properties of a resilient athletic flooring structure such as those required for DIN certification as disclosed above are either threshold values wherein the measured value is acceptable if it is at least or at most a set standard. or have a range of values required for certification. The capability of manipulating the size and spacing of the subfloor components to modify the measurable properties of the flooring structure permits designers to determine the most desirable measurable values for the prospective venue and then to design the subfloor components to yield those values.

Testimating of how changes in a component will produce changes in the measurable properties of a flooring structure is part art and part science and the methods of estimating are beyond the scope of this disclosure. However, it should be understood that scope of the claimed invention encompasses the range of useful changes of size and spacing of the components of the structure.

The distance between the top of the athletic floor and the base is ordinarily set before component specifications are made. Further, the thickness of hardwood floorings are industry standards and the flooring strips are laid proximal so that there is little opportunity to modify the measurable properties of the floor by modifying the sizing or spacing of the floor strips. As a consequence of these limitations, different subflooring designs and structures are used to produce different measurable values to the flooring structure.

In resilient flooring structures, a limiting restraint is secured to the base and engages some part of the subfloor so as to limit the upward travel of the floor after downward flexure. The subfloor rests on a resilient component and is joined to the athletic floor by way of a layer or layers of subflooring.

The configuration of the athletic flooring structure of this invention permits the modification of sizing and spacing of the subfloor components so as to alter the measurable properties of the flooring structure without changing the basic configurations of the structures.

Figure 4:
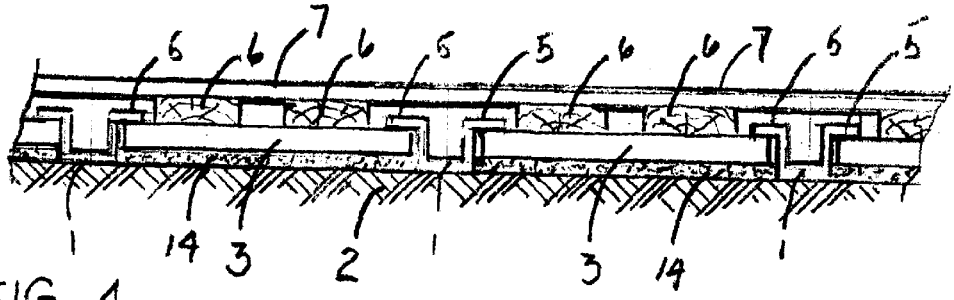
FIG. 4 is an elevational view of an embodiment of the flooring structure of FIG. 1 wherein the discrete pads are replaced with a continuous pad
Figure 5:
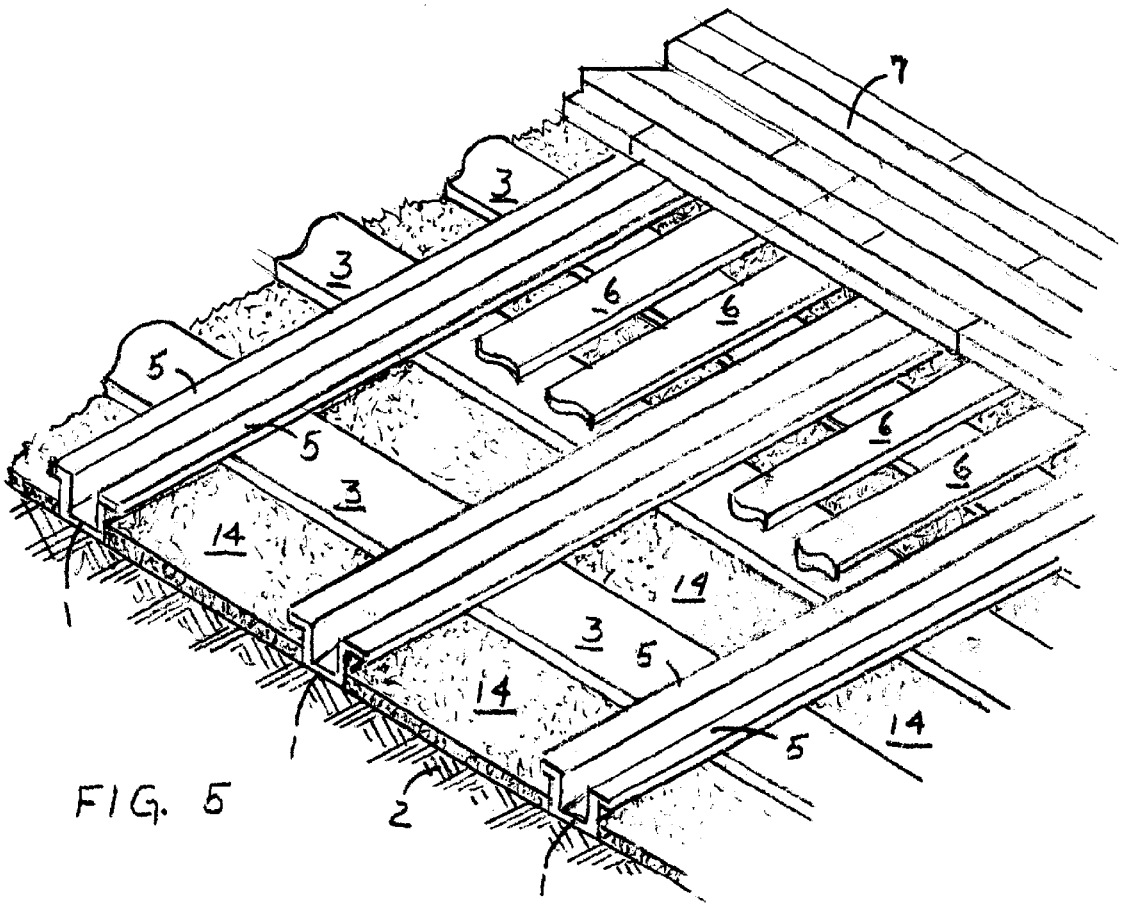
FIG. 5 is a fragmentary perspective view of the flooring structure of FIG. 4

Referring now to FIGS. 4 and 5 wherein the discreet resilient pads of FIGS. 1–3 has been replaced with a continuous pad 14 of resilient closed cell hydrophobic foam as an upward biasing means for struts 3. The use of a continuous strip of resilient foam to which struts 3 may be secured as a subassembly provides a uniformity of spacing and speeds the installation of the subfloor while reducing the void volumes in the subfloor so that forced ventalation can be achieved more economically.

The spacing of vertical restraints 1 has an effect on force attenuation and propagation properties of the finished flooring structure, and the spacing sets the length dimension of struts 3. The preferred center to center spacings of vertical restraints 1 is from 8 inches to 30 inches.

The durometer, size, shape, number and positioning of resilient pads 4 as shown in FIGS. 1 and 2 will have an effect on the standard deformation of the finished flooring structure as well as that of the ventilating air and water flow through the subfloor. The preferred durometers of pads 4 is from 40 to 70. The preferred shape of pads 4 is hemispherical. The preferred number of pads 4 per strut 3 is from 2 to 20. The thickness of resilient pads 14 as shown in FIGS. 4 and 5 will also have an effect on the standard deformation and ventilating air and water flow through the subfloor. The preferred thicknesses of pads 14 is from 0.25 to 1 inch.

The width and thickness and spacing of struts 3 will have an effect on the standard deformation and force attenuation of the finished flooring structure and the flow of ventilating air through the substructures. The preferred widths of struts 3 are from 1.5 to 12 inches. The preferred thicknesses of struts 3 are from 0.25 to 1 inch. The preferred spacing between struts 3 is from 0.25 to 20 inches.

The width and thickness and spacing of nailers 6 will have an effect on force attenuation, standard deformation, rolling load and ball rebound. The preferred widths for nailers 6 are 1.5 to 12 inches. The preferred thicknesses of nailers 6 are 0.25 to 1 inches. The preferred spacings between nailers 6 are 0.25 to 20 inches.

Wood flooring strips 7 while not a variable in the claimed structure, are a factor in establishing the values for the components which will produce the desired measurable values of the finished flooring structure.

In general, it is preferred to change the number and the spacing of standard sized components in the subflooring of the athletic flooring structures of this invention to archive a change in measurable values of the completed athletic flooring structure.

The above disclosures would enable one skilled in the art to make and use the invention for its intended purposes without undue experimentation. However it should be understood that the scope of the invention should not be limited to the embodiments disclosed but rather should be only limited by the scope of the appended claims and all equivalents thereto that would be made obvious thereby to one skilled in the art.

What is claimed is:

1. An athletic flooring structure comprising;

a) a multiplicity of parallel vertical restraints secured to a base and said restraints have as a part thereof outwardly directed lateral flanges, b) a multiplicity of spaced apart struts having a top surface and a bottom surface and said struts are positioned transversely to said vertical restraints and between said vertical restraints and under said lateral flanges, c) resilient upward biasing means secured to bottom surfaces of said struts so that said biasing means support said struts above said base and provide a biasing force that resiliently engages the top surfaces of said struts with said lateral flanges of the vertical restraints, d) a multiplicity of spaced apart nailers having a top surface and a bottom surface and said nailers are laid parallel to said vertical restraints and transverse to said struts and are secured to the top surface of said struts, e) a continuous floor made of strips of wood laid transverse to said nailers and secured thereto, and f) the spaces between said nailers and the spaces between said struts, all communicate so that the space between said base and said floor is ventilatable.

2. The athletic flooring structure of claim 1 wherein the center to center spacing of the vertical restraints is from 8 to 30 inches.

3. The athletic flooring structure of claim 1 wherein the struts have a width dimension of from 1.5 to 12 inches, and a thickness dimension of from 0.25 to 1 inch and a spacing between struts of from 0.25 to 20 inches.

4. The athletic flooring structure of claim 1 wherein said resilient upward biasing means is a multiplicity of discreet pads and the pads have a durameter from 40 to 70 and the number of pads per strut is between 2 and 10.

5. The athletic flooring structure of claim 1 wherein said resilient upward biasing means is a continuous strip of closed cell hydrophobic resilient foam having a thickness of from 0.25 to 1 inch.

6. The athletic flooring structure of claim 1 wherein the nailers have a width of from 1.5 to 12 inches and a thickness of from 0.25 to one inch and the spacing between nailers is from 0.25 to 20 inches.

7. An athletic flooring structure comprising;

a) a multiplicity of parallel vertical restraints secured to a base and said restraints have as a part thereof outwardly directed lateral flanges, and the center to center spacing of the vertical restraints is from 8 to 30 inches, b) a multiplicity of spaced apart struts having a top surface and a bottom surface and said struts are positioned transversely to said vertical restraints and between said vertical restraints and under said lateral flanges, and the width of the struts is from 1.5 to 12 inches and the thickness of the struts is from 0.25 to 1 inch and the spacing between struts is from 0.25 to 20 inches, c) a multiplicity of discreet resilient pads secured to bottom surfaces of said struts so that said pads support said struts above said base and provide a biasing force that resiliently engages the top surfaces of said struts with said lateral flanges of the vertical restraints, and the durameter of the pads is between 40 and 70, and the number of pads per strut is from 2 to 10, d) a multiplicity of spaced apart nailers having a top surface and a bottom surface and said nailers are laid parallel to said vertical restraints and transverse to said struts and are secured to the top surface of said struts, and the width of the nailers is from 1.5 to 12 inches and the thickness of the nailers is from 0.25 to 1 inch, and the spacing between nailers is from 0.25 to 20 inches.

e) a continuous floor made of strips of wood laid transverse to said nailers and secured thereto, and f) the spaces between said nailers and the spaces between said struts and the spaces between said pads all communicate so that the space between said base and said floor is ventilatable.

8. An athletic flooring structure comprising;

a) a multiplicity of parallel vertical restraints secured to a base and said restraints have as a part thereof outwardly directed lateral flanges, and the center to center spacing of the vertical restraints is from 8 to 30 inches, b) a multiplicity of spaced apart struts having a top surface and a bottom surface and said struts are positioned transversely to said vertical restraints and between said vertical restraints and under said lateral flanges, and the width of the struts is from 1.5 to 12 inches and the thickness of the struts is from 0.25 to 1 inch and the spacing between struts is from 0.25 to 20 inches, c) a resilient upward biasing means secured to the bottom surface of said struts and comprising a continuous strip of closed cell resilient hydrophobic foam which provides an upward bias to said struts and engages said struts with said outward directed lateral flanges of said vertical restraints and the thickness of said strip is from 0.25 to 1 inch, d) a multiplicity of spaced apart nailers having a top surface and a bottom surface and said nailers are laid parallel to said vertical restraints and transverse to said struts and are secured to the top surface of and said struts, and the width of the nailers is from 1.5 to 12 inches and the thickness of the nailers is from 0.25 to 1 inch, and the spacing between nailers is from 0.25 to 20 inches, e) a continuous floor made of strips of wood laid transverse to said nailers and secured thereto, and f) the spaces between said nailers and the spaces between said struts and the spaces between said pads all communicate so that the space between said base and said floor is ventilatable.

* * * * *